US007727694B2

(12) United States Patent
Murakami et al.

(10) Patent No.: US 7,727,694 B2
(45) Date of Patent: Jun. 1, 2010

(54) TONER FOR DEVELOPING ELECTROSTATIC IMAGE, AND IMAGE FORMING METHOD AND APPARATUS AND PROCESS CARTRIDGE USING THE TONER

(75) Inventors: Hiroyuki Murakami, Toyonaka (JP); Masahide Inoue, Numazu (JP); Masayuki Hagi, Minoo (JP); Takuya Kadota, Kobe (JP); Yoshihiro Mikuriya, Nishinomiya (JP); Hideaki Yasunaga, Ibaraki (JP); Hiroaki Katoh, Nagaokakyo (JP); Yoshimichi Ishikawa, Itami (JP); Kazuoki Fuwa, Toyonaka (JP)

(73) Assignee: Ricoh Company Limited, Tokyo (JP)

( * ) Notice: Subject to any disclaimer, the term of this patent is extended or adjusted under 35 U.S.C. 154(b) by 301 days.

(21) Appl. No.: 11/856,248

(22) Filed: Sep. 17, 2007

(65) Prior Publication Data

US 2008/0069598 A1 Mar. 20, 2008

(30) Foreign Application Priority Data

Sep. 19, 2006 (JP) ..... 2006-251998

(51) Int. Cl.
*G03G 15/08* (2006.01)
*G03G 9/00* (2006.01)

(52) U.S. Cl. ..... 430/108.1; 399/265

(58) Field of Classification Search ..... 430/108.1; 399/265

See application file for complete search history.

(56) References Cited

U.S. PATENT DOCUMENTS

| | | | | |
|---|---|---|---|---|
| 2006/0204882 | A1 | 9/2006 | Nozaki et al. | |
| 2006/0210902 | A1 | 9/2006 | Nakamura et al. | |
| 2006/0275686 | A1 | 12/2006 | Kadota et al. | |
| 2006/0292474 | A1 | 12/2006 | Mikuriya et al. | |
| 2007/0026335 | A1 | 2/2007 | Yamamoto et al. | |
| 2007/0059625 | A1 | 3/2007 | Yamamoto et al. | |
| 2007/0122729 | A1 | 5/2007 | Katoh et al. | |
| 2007/0148568 | A1 | 6/2007 | Kadota et al. | |
| 2007/0190443 | A1 | 8/2007 | Hagi et al. | |
| 2007/0207399 | A1 | 9/2007 | Kadota et al. | |
| 2007/0281232 | A1 * | 12/2007 | Yoshimura | 430/108.2 |

FOREIGN PATENT DOCUMENTS

| | | |
|---|---|---|
| AX | 2005-241670 | 9/2005 |
| JP | 2-171759 | 7/1990 |
| JP | 6-148931 | 5/1994 |
| JP | 8-137130 | 5/1996 |
| JP | 2752410 | 2/1998 |
| JP | 11-327303 | 11/1999 |
| JP | 2000-29237 | 1/2000 |
| JP | 3592501 | 9/2004 |
| JP | 3604267 | 10/2004 |
| JP | 2005-17660 | 1/2005 |

OTHER PUBLICATIONS

U.S. Appl. No. 12/197,651, filed Aug. 25, 2008, Katoh, et al.
U.S. Appl. No. 12/241,656, filed Sep. 30, 2008, Yasunaga, et al.
U.S. Appl. No. 11/624,525, filed Jan. 18, 2007, Hideaki Yasunaga et al.

* cited by examiner

*Primary Examiner*—John L Goodrow
(74) *Attorney, Agent, or Firm*—Oblon, Spivak, McClelland, Maier & Neustadt, L.L.P.

(57) ABSTRACT

A toner including toner particles including a binder resin, and a colorant, and an external additive present on a surface of the toner particles, wherein the external additive includes a silica having an average primary particle diameter of from 100 to 500 nm and a BET specific surface area of from 800 to 1000 $m^2/g$. An image forming method including forming an electrostatic image on an image bearing member; developing the electrostatic image with the toner to form a toner image; and transferring the toner image on to a receiving material. An image forming apparatus including an image bearing member bearing an electrostatic image; a developing device developing an electrostatic image with the toner to form a toner image on the image bearing member; a transfer device transferring the toner image to a receiving material; and a fixing device fixing the toner image on the receiving material.

14 Claims, 2 Drawing Sheets

TONER FOR DEVELOPING ELECTROSTATIC IMAGE, AND IMAGE FORMING METHOD AND APPARATUS AND PROCESS CARTRIDGE USING THE TONER

BACKGROUND OF THE INVENTION

1. Field of the Invention

The present invention relates to a toner for developing an electrostatic image. In addition, the present invention also relates to an image forming method, an image forming apparatus and a process cartridge using the toner.

2. Discussion of the Background

Electrophotographic image forming methods typically include the following processes:

(1) charging an image bearing member such as photoreceptors (charging process);
(2) irradiating the charged image bearing member with imagewise light to prepare an electrostatic latent image on the image bearing member (light irradiating process);
(3) developing the electrostatic latent image with a developer including a toner to prepare a toner image on the image bearing member (developing process);
(4) transferring the toner image onto a receiving material such as sheets of paper optionally via an intermediate transfer medium (transfer process); and
(5) fixing the toner image on the receiving material upon application of heat and pressure thereto (fixing process).

Dry developing methods for use in developing an electrostatic latent image are broadly classified into two component developing methods using a two component developer including a toner and a carrier, and one component developing methods using a one component developer including a toner and no carrier. Two component developing methods have an advantage in that images with relatively good image qualities can be produced but have drawbacks in that image qualities change after long repeated use due to deterioration of charging ability of the carrier, change of the ratio (T/C) of the toner (T) to the carrier (C) in a developer, etc.; it is troublesome to control the ratio (T/C) in a developing device; and the image forming apparatus becomes large in size. Therefore, recently one component developing methods, which do not have the above-mentioned drawbacks, attract attention.

In one component developing methods, a toner (i.e., a developer) is typically fed by at least one developing roller to a developing region at which the developing roller faces an image bearing member bearing an electrostatic latent image thereon. The electrostatic latent image is developed with the thus fed toner at the developing region, resulting in formation of a toner image on the image bearing member. In this regard, the toner layer formed on the developing roller is preferably as thin as possible. In particular, when a one component developer (i.e., toner) with a high electric resistance is used, the toner has to be charged in the developing device. Therefore, the toner layer formed on the developing roller has to be extremely thin.

If a strong mechanical stress is applied to the toner in such a thin toner layer forming process, problems in that the external additive of the toner is released from and/or embedded into toner particles of the toner after repeated image formation operations occur, and the surface of the developing roller changes its property or is abraded occur. In these cases, charging properties and fluidity of the toner change, and feeding properties of the toner on the surface of the developing roller change, thereby forming images with low image density or uneven image density and images having streaks.

In addition, when an external additive on toner particles is released therefrom or embedded thereinto, problems in that the toner is adhered to image forming members such as contact chargers tend to be caused. In attempting to solve the above-mentioned problems (releasing and embedding of an external additive, and application of strong stress to toner particles, developing rollers and image bearing members) on the toner side, toners including a porous material as an external additive or an internal additive have been proposed recently.

For example, published unexamined Japanese patent application No. (hereinafter referred to as JP-A) 08-137130 discloses a toner including toner particles including a resin having a low softening point as a main component, and a small particulate hollow or porous resin material covering the toner particles. It is described therein that the purpose thereof is to impart a good combination of fixability and durability to the toner. However, as a result of the present inventors' experiments, it is found that the toner particles cannot be fully covered with the particulate hollow or porous resin material when they are mixed using a hybridizer, and therefore the desired effects cannot be fully produced (specifically, the toner has poor durability).

JP-A 06-148931 discloses a toner including a mixture of toner particles and an agent (such as porous carbon) capable of absorbing toxic materials. It is described therein that the toxic material absorbing agent can efficiently absorb ozone adhered to the surface of an image bearing member, and thereby the life of the image bearing member can be prolonged. However, the method for mixing the toner particles with the absorbing agent is not described therein. As a result of the present inventors' experiments, it is found that the particle diameter of the absorbing agent has to be considerably large to absorb ozone. In such a case, the adhesiveness of the absorbing agent to the toner particles is weak, and thereby defective images (such as images with white spots) are formed.

Japanese patent No. 3592501 (i.e., JP-A 11-109824) discloses a technique in that a particulate porous material such as crosslinked polymers having elasticity (e.g., crosslinked polymethyl methacrylate) is supplied to the surface of an image bearing member to reduce the mechanical stresses applied to the toner particles and the developing roller.

JP-A 11-327303 discloses techniques in that an abrasion reducing agent (such as fluorine-containing materials) is included in a toner as an internal or external additive or is coated on the surface of carrier particles; and a porous material (such as molecular sieves (e.g., zeolite)) including such an abrasion reducing agent is used for a toner to reduce abrasion of the image bearing member used. The details (such as specific surface area and particle diameter) of the porous material are not described therein.

JP-A 02-171759 discloses a toner including a porous material having an internal specific surface area of not less than 500 $m^2/g$ and JP-A 2000-29237 discloses a technique in that a porous material is added to a developer before the developer starts to be used, to eliminate odor. In order to produce such effect, the porous material has to have a large particle diameter. In that case, the adhesiveness of the porous material to toner particles is low, and thereby defective images (such as white spot images) tend to be formed.

JP-A 2005-17660 discloses a toner including a ring-form polyolefin resin serving as a binder resin (substitute for a polyester resin) and a porous silica with a specific surface area of from 500 to 700 $m^2/g$ which serves as an internal additive and which is added to improve the fixability and transparency of the toner. However, the porous silica cannot prevent occurrence of the problems in that the external additive is released from or embedded into toner particles of the toner after repeated image forming operations, and the surface of the developing roller changes its property or is abraded.

Japanese patent No. 2752410 (i.e., JP-A 02-221964) discloses a toner including a porous material, which has a primary particle diameter of from 2 to 15 μm and into which a silicone oil penetrates, to impart good offset resistance to the toner. However, the toner has insufficient charge properties. In addition, Japanese patent No. 3604267 (i.e., JP-A 11-184140) discloses a toner including a particulate inorganic material serving as an external additive which has a porous structure or a high-order structure and includes a release agent in the spaces in the structure, to impart good offset resistance to the toner.

JP-A 2005-241670 discloses a toner including as an external additive a porous titanium oxide having a BET specific surface area of not less than 90 $m^2/g$ so that the external additive is hardly released from toner particles and can be easily removed by cleaning even if released from toner particles, resulting in prevention of occurrence of a background development problem. As a result of the present inventors' experiments, it is found that the exemplified porous titanium oxide, which has a specific surface area of from 90 to 100 $m^2/g$, cannot prevent occurrence of the problems in that the external additive is released from or embedded into toner particles of the toner after repeated image forming operations, and the surface of the developing roller changes its property or is abraded.

Because of these reasons, a need exists for a toner which can maintain a good combination of charging property and fluidity and has a long life without being adhered to image forming members (such as chargers) and without damaging the image forming members because the external additive thereof is hardly released from or embedded into toner particles thereof.

SUMMARY OF THE INVENTION

As an aspect of the present invention, a toner is provided which includes toner particles including at least a binder resin and a colorant, and an external additive present on a surface of the toner particles, wherein the external additive includes a silica having an average primary particle diameter of from 100 to 500 nm and a BET specific surface area of from 800 to 1000 $m^2/g$, which is determined by a BET absorption method. The silica is preferably a porous silica.

As another aspect of the present invention, an image forming method is provided which includes:

forming an electrostatic image on an image bearing member;

developing the electrostatic image with a developer including the toner mentioned above to form a toner image on the image bearing member; and transferring the toner image onto a receiving material optionally via an intermediate transfer medium.

As yet another aspect of the present invention, an image forming apparatus is provided which includes:

an image bearing member configured to bear an electrostatic image thereon;

a developing device configured to develop the electrostatic image with a developer including the toner mentioned above to form a toner image on the image bearing member;

a transfer device configured to transfer the toner image to a receiving material optionally via an intermediate transfer medium; and a fixing device configured to fix the toner image on the receiving material.

As a further aspect of the present invention, a process cartridge is provided which includes at least an image bearing member configured to bear an electrostatic latent image thereon, and a developing device configured to develop the electrostatic latent image with a developer including the toner mentioned above to form a toner image on the image bearing member, which are detachably attachable to an image forming apparatus as a unit.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
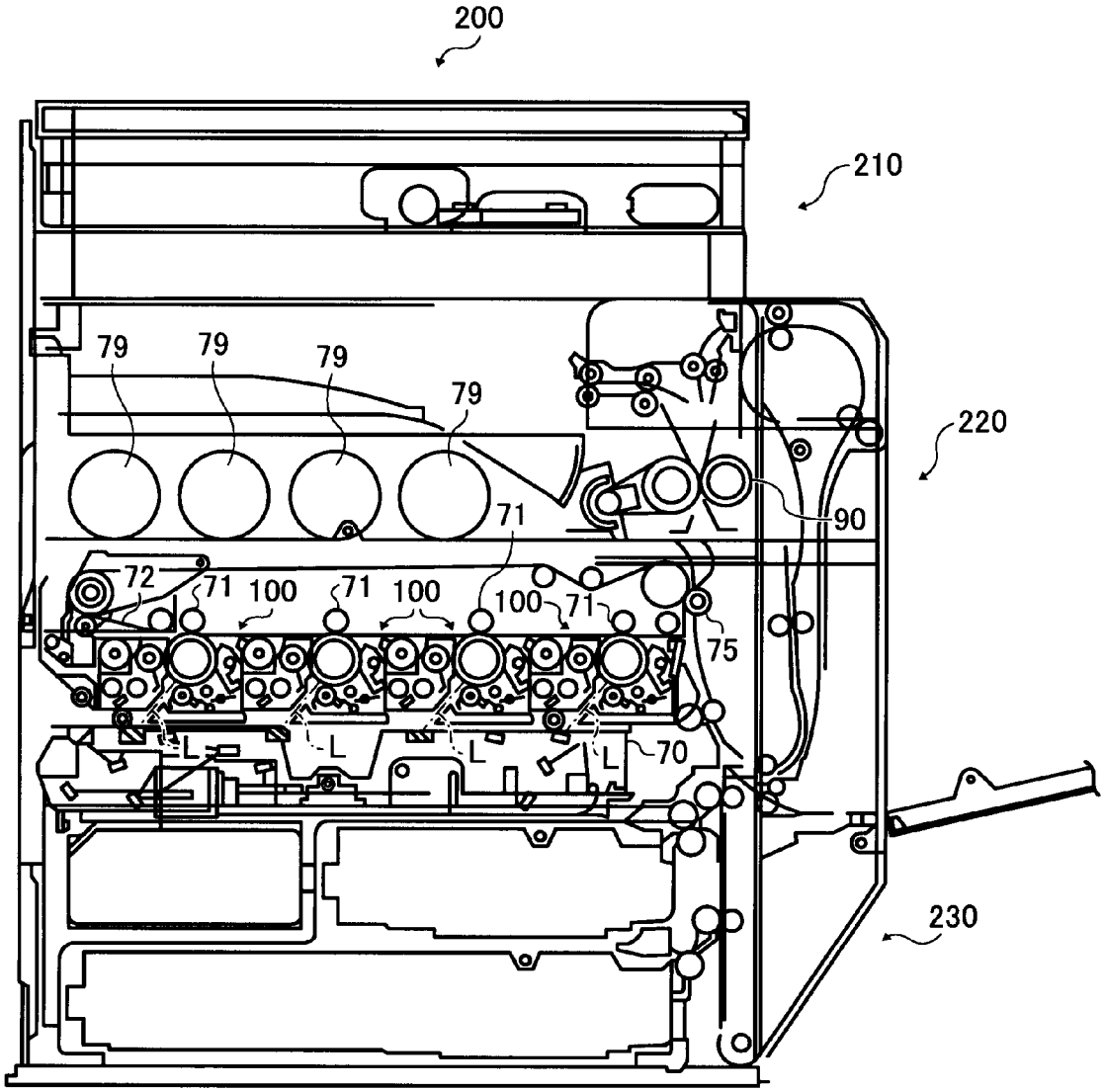
FIG. 1 is a schematic view illustrating an example of the image forming apparatus of the present invention.

At first, the toner of the present invention will be explained.

The toner of the present invention includes toner particles including at least a binder resin and a colorant, and an external additive present on a surface of the toner particles, wherein the external additive includes a silica having an average primary particle diameter of from 100 to 500 nm and a specific surface area of from 800 to 1000 $m^2/g$, which is determined by a BET absorption method. The silica is preferably a porous silica.

Such an external additive can be prepared, for example, by a method such that a porous silica having a particle diameter on the order of micrometers is treated to prepare a silica having a large particle diameter and a large specific surface area. This property is different from those of conventional silicas mentioned below in Comparative Examples 1 and 2. Such an external additive is hardly released from or embedded into toner particles, and therefore the resultant toner has a good combination of charging property and fluidity and has a long life without being adhered to image forming members (such as chargers) and without damaging the image forming members.

When the external additive has a BET specific surface area in the above-mentioned range, the toner has a good combination of adhesiveness and cushion property. When the toner has a good cushion property, occurrence of the problem in that the toner is adhered to image forming members (such as chargers) can be prevented.

The average primary particle diameter of a silica used as an external additive is preferably from 100 to 500 nm and more preferably from 100 to 300 nm. When the average primary particle diameter is too small, the toner cannot well absorb the stresses applied to the toner by a developer layer thickness controlling member provided in a developing device to form a thin developer layer on a developing member, and thereby the effects of the present invention cannot be fully produced. In contrast, when the average primary particle diameter is too large, the external additive is easily released from toner particles, and thereby the effects of the present invention cannot be fully produced.

In general, conventional silicas having a relatively large primary particle diameter on the order of 100 nm typically have a BET specific surface area of less than 30 $m^2/g$, and conventional silicas having a relatively small primary particle diameter on the order of 10 nm typically have a BET specific surface area of about 100 $m^2/g$. However, silicas for use in the toner of the present invention have a relatively large primary particle diameter of from 100 to 500 nm but have a large BET specific surface area of from 800 to 1000 $m^2/g$. This is because the silicas are porous. Since having a large BET specific surface area, the porous silicas can absorb moisture adhered to toner particles under high humidity conditions. Therefore, the toner can maintain good charging property even when environmental conditions (such as humidity) change.

The content of a silica in the toner of the present invention is from 0.1 to 1.5 parts by weight, and preferably from 0.5 to 1.5 parts by weight, per 100 parts by weight of toner particles. When the content is too low, the toner has poor cushion property, and therefore the toner has poor durability, and in addition image forming members such as developing rollers are easily damaged thereby, resulting in shortening of the life of the image forming members. In contrast, when the content is too high, the external additive is easily released from toner particles, and thereby defective images such as images with streaks and/or white spots are produced because the toner particles, from which the external additive is released, are adhered to image forming members such as chargers.

Porous silicas can be prepared by various methods. The preparation methods are broadly classified into methods in which when a silica is synthesized, porosity is imparted to the silica, and methods in which a non-porous silica is treated so as to be porous.

The first mentioned methods will be explained, but the preparation method is not limited thereto.

The methods are called gelation methods. Specifically, a porous silica can be prepared by finely pulverizing a silica xerogel. The volume of pores of the thus prepared silica is relatively small. Another method in which a silica hydrogel is dried such that the pores thereof do not shrink can also be used. The volume of pores of the thus prepared silica is relatively large. In this regard, the volume of pores can be controlled by controlling the partial pressure of water vapor in the drying process in the manufacturing processes (including reaction, aging, washing with water and drying processes), or by controlling the content of water included in the silica hydrogel.

The toner particles of the toner of the present invention include a binder resin, a colorant and optional additives (such as release agents and charge controlling agents). The toner particles can be provided, for example, by the following methods.

(1) Pulverization Methods

At first, a binder resin, a colorant, and optional additives such as release agents and charge controlling agents are kneaded upon application of heat thereto to be mixed. After being cooled, the kneaded mixture is pulverized, and the pulverized mixture is then classified to prepare toner particles.

(2) Suspension Polymerization Methods

A colorant, and optional additives such as release agents and charge controlling agents are dissolved or dispersed in one or more monomers which are to be polymerized to constitute a binder resin. After a polymerization initiator is added to the mixture, the mixture is dispersed in an aqueous medium including a dispersion stabilizer. The mixture is heated to be subjected to a suspension polymerization. The reaction products are filtered, and the solid components are washed and dried to prepare toner particles.

(3) Emulsion Polymer Aggregation Methods

Primary particles of a binder resin having an acid group and is prepared by an emulsion polymerization method are mixed with a colorant and a charge controlling agent to be aggregated (i.e., to form secondary particles). The dispersion is agitated at a temperature higher than the glass transition temperature of the binder resin to fix the secondary particles. Then the dispersion is filtered and the solid components are dried to prepare toner particles.

(4) Phase-Conversion Emulsification Methods

A binder resin having a hydrophilic group and a colorant are dissolved in an organic solvent. Then the resin in the solution is neutralized to perform phase conversion. The dispersion is then dried to prepare toner particles.

However, the method for providing the toner particles of the toner of the present invention is not limited thereto.

Next, toner particles prepared by a pulverization method will be explained in detail. However, the toner particles for use in the toner of the present invention are not limited thereto.

Binder Resin

The binder resin of the toner of the present invention is not particularly limited. Specific examples of the resins for use as the binder resin include polyester resins, (meth)acrylic resins, styrene-(meth)acrylic copolymers, epoxy resins, cyclic olefin copolymers (COC) (e.g., TOPAS-COC from Ticona), etc. Among these resins, polyester resins are preferably used.

Suitable polyester resins for use as the binder resin include polyester resins prepared by subjecting a polyhydric alcohol and a polybasic carboxylic acid to a polycondensation reaction.

Suitable polyhydric alcohol components include diols and polyols. Specific examples of diols include alkylene oxide adducts of bisphenol A such as polyoxypropylene(2.2)-2,2-bis(4-hydroxyphenyl)propane, polyoxypropylene(3.3)-2,2-bis(4-hydroxyphenyl)propane, polyoxypropylene(6)-2,2-bis(4-hydroxyphenyl)propane, and polyoxyethylene(2.0)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropyleneglycol, polyethylene glycol, polytetramethylene glycol, bisphenol A, hydrogenated bisphenol A, etc.

Specific examples of the polyhydric alcohols having three or more hydroxyl groups include sorbitol, 1,2,3,6-hexanetetrol, 1,4-sorbitane, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylol ethane, trimethylol propane, 1,3,5-trihydroxymethyl benzene, etc.

Polybasic carboxylic acids include dibasic carboxylic acids and polybasic carboxylic acids having three or more carboxyl groups.

Specific examples of the dibasic carboxylic acids include maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid, isooctenylsuccinic acid, n-octylsuccinic acid, isooctylsuccinic acid, anhydrides and lower alkyl esters of these acids, etc.

Specific examples of the polybasic carboxylic acids include 1,2,4-benzenetricarboxylic acid (i.e., trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, trimers of embole, anhydrides and lower alkyl esters of these acids, etc.

In addition, vinyl polyester resins which are prepared by subjecting a mixture including monomers for preparing a polyester resin, one or more vinyl monomers for preparing a vinyl resin and one or more reactive monomers capable of reacting the monomers for the polyester resin and vinyl resin to a polycondensation reaction and a radical polymerization reaction in a reaction vessel can also be used as the binder resin. The reactive monomers are monomers which can be used for both a polycondensation reaction and a radical polymerization reaction. Specifically, the reactive monomers are monomers having both a carboxyl group and a vinyl group therein. Specific examples thereof include fumaric acid, maleic acid, acrylic acid, methacrylic acid, etc.

Specific examples of the monomers for use in preparing polyester resins include the polyhydric alcohols and polybasic carboxylic acids mentioned above.

Specific examples of the monomers for use in preparing vinyl resins include styrene and styrene derivatives such as styrene, o-methylstyrene, m-methylstyrene, p-methylstyrene, α-methylstyrene, p-ethylstyrene, 2,4-dimethylstyrene, p-tert-butylstyrene, and p-chlorostyrene; ethylene-type unsaturated monoolefins such as ethylene, propylene, butylene and isobutylene; alkyl esters of methacrylic acid such as methyl methacrylate, n-propyl methacrylate, isopropyl methacrylate, n-butyl methacrylate, isobutyl methacrylate, tert-butyl methacrylate, n-pentyl methacrylate, isopentyl methacrylate, neopentyl methacrylate, 3-methylbutyl methacrylate, hexyl methacrylate, octyl methacrylate, nonyl methacrylate, decyl methacrylate, undecyl methacrylate, and dodecyl methacrylate; alkyl esters of acrylic acid such as methyl acrylate, n-propyl acrylate, isopropyl acrylate, n-butyl acrylate, isobutyl acrylate, tert-butyl acrylate, n-pentyl acrylate, isopentyl acrylate, neopentyl acrylate, 3-methylbutyl acrylate, hexyl acrylate, octyl acrylate, nonyl acrylate, decyl acrylate, undecyl acrylate, and dodecyl acrylate; unsaturated carboxylic acids such as acrylic acid, methacrylic acid, itaconic acid, and maleic acid; acrylonitrile, esters of maleic acid, esters of itaconic acid, vinyl chloride, vinyl acetate, vinyl benzoate, vinyl methyl ketone, vinyl hexyl ketone, vinyl methyl ether, vinyl ethyl ether, vinyl isobutyl ether, etc.

Specific examples of the radical polymerization initiator include azo- or diazo-type initiators such as 2,2'-azobis(2,4-dimethylvaleronitrile), 2,2'-azobisisobutylonitrile, 1,1'-azobis(cyclohexane-1-carbonitrile), and 2,2'-azobis-4-methoxy-2,4-dimethylvaleronitrile; peroxide-type initiators such as benzoyl peroxide, dicumyl peroxide, methyl ethyl ketone peroxide, isopropylperoxy carbonate, and lauroyl peroxide; etc.

The toner of the present invention preferably includes a first binder resin selected from polyester resins prepared by subjecting a polyhydric alcohol and a polybasic carboxylic acid to a polycondensation reaction and a second binder resin selected from vinyl polyester resins. In this case, the toner has a good combination of releasability from fixing members and offset resistance. More preferably, the first binder resin is selected from polyester resins obtained from an alkylene oxide adduct of bisphenol A (serving as a polyhydric alcohol) and terephthalic acid and/or fumaric acid (serving as a polybasic carboxylic acid). In addition, the second binder resin is more preferably selected from vinyl polyester resins obtained from monomers for polyester resins such as alkylene oxide adducts of bisphenol A, terephthalic acid, trimellitic acid and succinic acid, monomers for vinyl resins such as styrene and butyl acrylate, and a reactive monomer such as fumaric acid.

The weight ratio of a first binder resin to a second binder resin is from 20/80 to 45/55, and preferably from 30/70 to 40/60. As mentioned below, the first binder resin may include a wax. When the content of the first binder resin is too low, the toner has poor releasability and poor hot offset resistance. In contrast, when the content of the first binder resin is too high, the toner has poor high temperature preservability and produces images with low glossiness.

The softening point of the binder resin including a first binder resin and a second binder resin is from 100 to 130° C., and preferably from 105 to 130° C. It is preferable that each of first and second binder resins has a softening point in the above-mentioned range.

The first binder resin (which may include a wax) preferably has an acid value of from 5 to 50 mgKOH/g, and more preferably from 10 to 40 mgKOH/g. The second binder resin preferably has an acid value of from 0 to 10 mgKOH/g, and more preferably from 1 to 5 mgKOH/g. When polyester resins having such an acid value are used for the toner, colorants can be well dispersed in toner particles and the resultant toner has good charge properties (i.e., the toner has a sufficient amount of charge).

The first binder resin preferably includes tetrahydrofuran-insoluble components in an amount of from 0.1 to 15% by weight, preferably from 0.2 to 10% by weight, and more preferably from 0.3 to 5% by weight, based on the total weight of the first binder resin. In this case, the toner can have a good hot offset resistance.

It is preferable that a hydrocarbon wax is included in a first binder resin when the first binder resin is synthesized. Specifically, it is preferable that when a first binder resin is synthesized, a mixture of monomers for the first binder resin (e.g., an acid monomer and an alcohol monomer for preparing a polyester resin) and a hydrocarbon wax is subjected to a polymerization reaction (e.g., a polycondensation reaction). When a vinyl polyester resin is used as the first binder resin, it is preferable that a mixture of monomers for a polyester resin and a hydrocarbon wax is agitated upon application of heat thereto to perform a polycondensation reaction while dropping monomers for a vinyl resin thereto to perform a radical polymerization reaction.

Suitable waxes for use in the toner of the present invention include hydrocarbon waxes with a low polarity. In this case, the resultant toner has good releasability from fixing members such as fixing rollers.

Among hydrocarbon waxes, waxes which are constituted of carbon atoms and hydrogen atoms and which do not include a group such as ester groups, alcoholic groups, and amide groups are preferably used. Specific examples thereof include petroleum waxes such as polyolefin waxes (e.g., polyethylene, polypropylene, and ethylene-propylene copolymers), paraffin waxes and microcrystalline waxes; synthesized waxes such as Fischer Tropsch waxes; etc. Among these waxes, polyethylene waxes, paraffin waxes and Fischer Tropsch waxes are preferably used, and polyethylene waxes and paraffin waxes are more preferably used.

The wax included in the toner of the present invention preferably has a melting point of from 70 to 90° C. In this regard, the melting point of a wax is defined as the temperature at which an endothermic peak is observed when the wax is subjected to a differential scanning calorimetry (DSC). When the melting point is too high, the wax in toner particles constituting a toner image is not sufficiently melted when the toner image is fixed. Therefore, the toner image has poor releasability from the fixing member. In contrast, when the melting point is too low, the toner has poor high temperature preservability. Specifically, when the toner is preserved under high temperature conditions, toner particles are adhered to each other, resulting in formation of defective images. In order that the toner has good releasability from fixing members at a low fixing temperature, the melting point of the wax included in the toner is preferably from 70 to 85° C., and more preferably from 70 to 80° C.

The wax included in the toner of the present invention preferably has a sharp endothermic peak such that the half width of the peak is not greater than 7° C. when the endothermic peak is obtained in a temperature rising process in DSC. If the wax has a broad peak, the toner tends to have poor high temperature preservability because the wax is melted at a relatively low temperature.

The content of a wax in the toner of the present invention is from 2 to 10% by weight, preferably from 3 to 8% by weight, and more preferably from 3 to 6% by weight, based on the total weight of the toner. When the content is too low, the amount of wax exuding from toner particles is small, and thereby the releasability of the toner from fixing members is deteriorated. In contrast, when the content is too high, the amount of wax present on the surface of toner particles increases, and therefore the toner has poor fluidity. In this case, the transferability of the toner from a developing roller to an image bearing member, and from an image bearing member to a receiving material deteriorates, resulting in deterioration of image qualities. In addition, since the wax present on the surface of toner particles is easily released therefrom, a problem in that developing members (such as developing rollers) and image bearing members are contaminated with the released wax occurs.

The toner of the present invention includes a colorant. Known pigments and dyes can be used as the colorant. Specific examples of the pigment and dyes include carbon black, Aniline Black, calco-oil blue, chrome yellow, ultramarine blue, Dupont Oil Red, Quinoline Yellow, methylene blue chloride, copper Phthalocyanine, Malachite Green oxalate, lampblack, Rose Bengal, C.I. Pigment Red 48:1, C.I. Pigment Red 122, C.I. Pigment Red 57:1, C.I. Pigment Red 184, C.I. Pigment Yellow 97, C.I. Pigment Yellow 12, C.I. Pigment Yellow 17, C.I. Pigment Yellow 74, C.I. Solvent Yellow 162, C.I. Pigment Yellow 180, C.I. Pigment Yellow 185, C.I. Pigment Blue 15:1, C.I. Pigment Blue 15:3, etc.

The added amount of a colorant is preferably from 2 to 15 parts by weight per 100 parts by weight of the binder resin. It is preferable to use a colorant master batch which is prepared, for example, by dispersing a colorant in a mixture of a first binder resin and a second binder resin because the colorant can be well dispersed in the binder resin. The content of a colorant in such a master batch is preferably from 20 to 40% by weight. The content of a colorant master batch in the toner is determined such that the amount of the colorant in the colorant master batch falls in the range mentioned above.

The toner of the present invention can include a charge controlling agent.

Specific examples of the charge controlling agents include Nigrosine dyes, triphenyl methane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and its compounds, tungsten and its compounds, fluorine-containing activators, metal salts of salicylic acid, metal salts of salicylic acid derivatives, etc. These materials can be used alone or in combination.

Specific examples of the marketed charge controlling agents include BONTRON 03 (Nigrosine dye), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), and BONTRON E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and COPY CHARGE NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, and polymers having a functional group such as a sulfonate group, a carboxyl group, a quaternary ammonium group, etc. Among these charge controlling agents, charge controlling agents capable of imparting a negative charge to the toner can be preferably used.

The content of the charge controlling agent in the toner of the present invention is determined depending on the variables such as choice of binder resin, presence of additives, and dispersion method. In general, the added amount of the charge controlling agent is preferably from 0.1 to 10 parts by weight, and more preferably from 0.2 to 5 parts by weight, per 100 parts by weight of the binder resin included in the toner. When the added amount is too large, the charge quantity of the toner excessively increases, and thereby the electrostatic attraction between the developing roller and the toner increases, resulting in deterioration of fluidity and decrease of image density. When the added amount is too small, the effects of the charge controlling agent are hardly produced.

The toner of the present invention can include an external additive other than the silica mentioned above to improve the fluidity, developability, chargeability and durability of the toner.

Specific examples of such external additives include silica, zinc oxide, tin oxide, sand-lime, titanium oxide, clay, mica, wollastonite, diatom earth, chromium oxide, cerium oxide, red iron oxide, antimony trioxide, magnesium oxide, aluminum oxide, zirconium oxide, barium sulfate, barium carbonate, calcium carbonate, silicon carbide, silicon nitride, etc.

The total amount of the external additives in the toner is preferably from 1.0 to 5.0 parts by weight per 100 parts of the toner particles. When the total amount is too large, a background development problem in that background of images is soiled with particles of the toner occurs, and developability and releasability of the toner deteriorate. In contrast, when the total amount is too small, the fluidity, transferability, durability and high temperature preservability of the toner deteriorate.

When the toner of the present invention is prepared by a pulverization method, at first a first binder resin, a second binder resin, a colorant and optional additives are mixed and the mixture is kneaded upon application of heat thereto. After being cooled, the kneaded mixture is pulverized and then classified to prepare toner particles having a targeted average particle diameter. In this regard, the average particle diameter of the toner particles is preferably from 4 to 10 μm and more preferably from 5 to 10 μm. The thus prepared toner particles are mixed with one or more external additives to prepare the toner of the present invention.

Next, an embodiment of the image forming apparatus and process cartridge of the present invention will be explained referring to FIGS. 1 and 2.

FIG. 1 illustrates the cross section of a full color image forming apparatus.

Referring to FIG. 1, an image forming apparatus 200 includes a reading section 210 configured to read an original image, an image forming section 220, and a receiving material containing and feeding section 230. The image forming section 220 includes four process cartridges 100 (for forming yellow (Y), cyan (C), magenta (M) and black (K) images), which are arranged side by side in the main body of the image forming apparatus, an endless intermediate transfer belt 72 serving as an intermediate transfer medium, a secondary transfer roller 75 configured to transfer a toner image on the intermediate transfer belt to a receiving material, toner bottles 79 (serving as toner containers) configured to supply different color toners to the respective process cartridges 100, etc.

Different color toner images formed on four photoreceptors 10 (illustrated in FIG. 2) are transferred on the intermediate transfer belt 72 while overlaid. The process cartridge of the present invention includes at least an image bearing member and a developing device and is detachably attachable to the image forming apparatus 200 as a unit. The configurations and operations of the four process cartridges 100 are substantially the same except that the color of the toner is different from each other.

Figure 2:
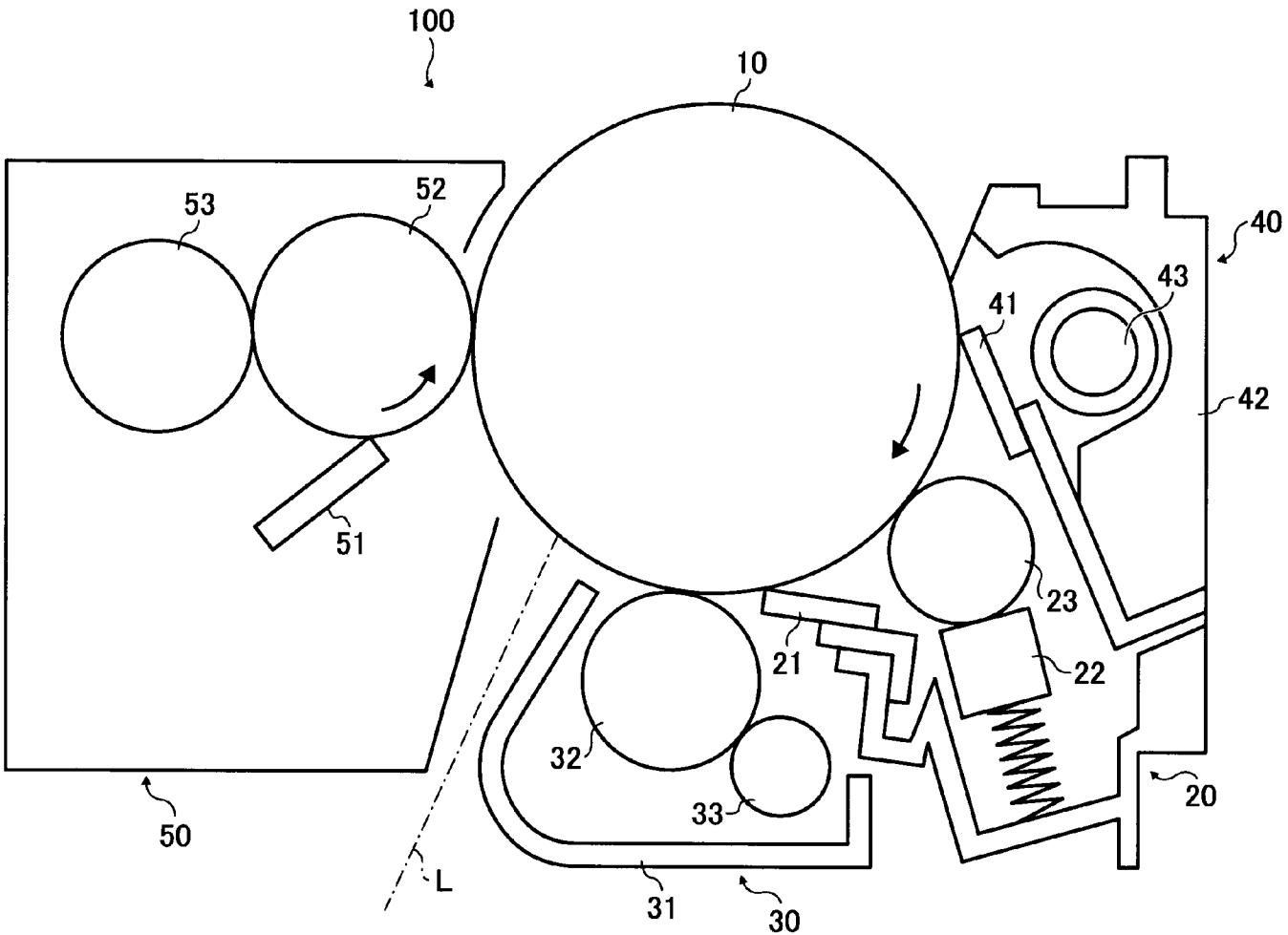
FIG. 2 is a schematic view illustrating an example of the process cartridge of the present invention.

FIG. 2 illustrates the cross section of the process cartridge 100. The process cartridge 100 includes the photoreceptor 10 serving as an image bearing member. Around the photoreceptor 10, a cleaning device 40, a lubricant applicator 20, a charging device 30, and a developing device 50 are arranged.

The charging device 30 includes a charger 31 including a charging roller 32, which serves as a charging member and is arranged so as to face the surface of the photoreceptor 10, and a charging roller cleaner 33 configured to clean the surface of the charging roller 32.

The charging roller 32 uniformly charges the surface of the photoreceptor 10. Specific examples of the charging devices 31 include non-contact charging devices such as scorotron chargers and corotron chargers, which use a charge wire; contact chargers which contact a rubber roller having a medium resistance with the surface of a photoreceptor; and short range chargers which use a roller set closely to the surface of a photoreceptor. The charger 31 illustrated in FIG. 2 is a contact charger.

Scorotron chargers have been broadly used for negatively charging photoreceptors, but have a drawback in that a large amount of ozone is generated. Therefore, recently scorotron chargers are used only for limited applications. Corotron chargers positively charge photoreceptors. Although the amount of ozone generated by corotron chargers is small, the chargers are not used popularly.

Recently, contact roller charging methods and non-contact roller charging methods are mainly used for electrophotographic image forming apparatuses because the manufacturing costs of charging rollers are reduced. The roller charging methods are classified into DC/AC charging methods in which a DC voltage on which an AC voltage is superimposed is applied to a photoreceptor and DC charging methods in which only a DC voltage is applied to a photoreceptor. When DC/AC charging methods are used, high quality images can be produced, but a filming problem in that a toner film is formed on a photoreceptor is easily caused.

DC/AC charging methods for contact roller charging methods have an advantage such that the potential of a photoreceptor is hardly influenced by change of resistance of the charging roller due to change of environmental conditions by performing constant AC current controlling, but have disadvantages such that the costs of the power source increases and noise due to an alternating high frequency wave is generated.

When only a DC voltage is used, the potential of a photoreceptor is seriously influenced by change of resistance of the charging roller due to change of environmental conditions. Therefore, it is necessary to provide any applied voltage compensation device when DC charging methods are used.

When DC/AC charging methods are used for non-contact roller charging methods, images with uneven image density are formed if the gap between the photoreceptor and the charger changes. Therefore, it is necessary to provide any applied voltage compensation device similarly to the case where only a DC voltage is applied. Non-contact roller charging methods have an advantage in that degree of contamination of the charging roller with foreign materials such as toner particles is lower than that in the contact charging methods. In order to apply a proper voltage to a charging roller, a device which detects the temperature in the vicinity of the charging roller and changes the applied voltage depending on the temperature, and a device which periodically detects the degree of contamination of the surface of the photoreceptor and changes the applied voltage depending on the degree of contamination are used. By using such devices, the potential of the photoreceptor can be controlled so as to be from about −500V to about −700V.

The method for driving the charging roller 32 is broadly classified into a driving method in which the charging roller 32 is contacted with photoreceptor 10 to be driven, or a driving method in which the charging roller is driven by a gear rotating the photoreceptor 10. The former method is typically used for low speed image forming apparatuses. The latter method is typically used for high speed image forming apparatuses or image forming apparatuses that are required to produce high quality images.

When the charging roller 32 is contaminated, the charging ability of the contaminated portion of the charging roller deteriorates, and thereby the potential of a portion of the photoreceptor facing the contaminated portion is decreased, resulting in formation of abnormal images. In order to prevent formation of such abnormal images, the charging roller cleaner 33 is contacted with the charging roller 32. The charging roller cleaner 33 is typically made of a melamine resin, and is driven by the charging roller 32 without receiving any particular driving force to clean the surface of the charging roller 32.

The charging roller 32 preferably has a metal shaft, an electroconductive layer formed on the metal shaft, and an outermost layer formed on the electroconductive layer. A voltage applied to the metal shaft from a power source to be applied to the surface of the photoreceptor 10 via the outermost layer and the electroconductive layer of the charging roller 32. The metal shaft of the charging roller 32 extends in the longitudinal direction of the photoreceptor 10, and the charging roller 32 is pressed to the photoreceptor at a predetermined pressure. Therefore, a nip with a predetermined width is formed by the charging roller 32 and the photoreceptor 10. The photoreceptor is rotated by a driving device (not shown), and the charging roller 32 is rotated while driven by the photoreceptor 10. The photoreceptor 10 is charged by the charging roller 32 in the vicinity of the nip.

The electroconductive layer is preferably made of a non-metal material having a low hardness in order that the charging roller 32 can be uniformly contacted with the photoreceptor 10. Specific examples of the non-metal materials include resins such as polyurethane, polyether, and polyvinyl alcohol, and rubbers such as hydrin rubbers, EPDMs and NBRs. An electroconductive material such as carbon black, graphite, titanium oxide and zinc oxide is added thereto to impart electroconductivity to the layer.

The outermost layer is preferably made of a material having a medium electric resistance of from $10^2$ to $10^{10}\Omega$. Specific examples thereof include resins such as nylon, polyamide, polyimide, polyurethane, polyester, silicone, fluorine-containing resins (such as TEFLON), polyacetylene, polypyrrole, polythiophene, polycarbonate, polyvinyl, etc. Among these materials, fluorine-containing resins are preferably used because of having high contact angle against water. Specific examples of the fluorine-containing resins include polyvinylidene fluoride, polyethylene fluoride, vinylidene fluoride-tetrafluoroethylene copolymers, vinylidene fluoride-tetrafluoroethylene-hexafluoropropylene copolymers, etc.

In order that the outermost layer has a medium electric resistance of from $10^2$ to $10^{10}\Omega$, electroconductive materials such as carbon black, graphite, titanium oxide, zinc oxide, tin oxide, and iron oxide can be included thereto.

The developing device 50 includes a developing roller 52 configured to supply a developer including the toner of the present invention to the photoreceptor 10, a developer supply roller 53 configured to supply the developer to the developing roller 52, and a developer layer thickness control member 51 configured to control the thickness of the developer layer on the surface of the developing roller 52.

In this embodiment, the developing roller 52 is made of a metal such as aluminum, and the developer layer control member 51 is made of an elastic material, but the materials are not limited thereto.

The surface of the developing roller 52 is subjected to blast finishing using glass beads so as to have a desired surface roughness (i.e., Arithmetical Mean Deviation of the Profile Ra) of from 0.2 to 0.5 μm. The surface roughness can be easily controlled by controlling the pressure for spraying glass beads to the surface of the developing roller. Since the surface of the developing roller 52 is roughened, the developing roller can bear a predetermined amount of developer thereon. A developing bias is applied between the developing roller 52 and the photoreceptor 10. The developing roller 52 is counterclockwise rotated while bearing the developer thereon. The thickness of the developer is controlled by the developer layer thickness control member 51, and the developer layer is transported to a developing region in which the developing roller 52 faces the photoreceptor 10. The electrostatic image formed on the photoreceptor 10 is developed with the toner included in the developer layer, resulting in formation of a toner image on the surface of the photoreceptor 10.

The developer layer thickness control member 51 is a plate of a metal such as SUS and phosphor bronze, to the surface of which an elastic material (such as rubbers) is attached. The free end of the developer layer thickness control member 51 is contacted with the surface of the developing roller 52 at a pressure of from 10 to 40 N/m to form a thin developer layer on the surface of the developing roller 52 while frictionally charging the developer. A bias is applied to the developer thickness control member 51 so that the developer has a proper charge.

Specific examples of the materials for use as the elastic material of the developer layer thickness control member 51 include rubbers such as styrene-butadiene rubbers, acrylonitrile-butadiene rubbers, acrylic rubbers, epichlorohydrin rubbers, urethane rubbers, silicone rubbers, and combinations thereof. Among these materials, combinations of epichlorohydrin rubbers and acrylonitrile-butadiene rubbers are preferably used.

A waste toner collection coil 43 (i.e., a toner feeding auger) is arranged in the vicinity of a cleaning blade 41 of the cleaning device 40. After the waste toner collected by the cleaning blade 41 is contained in a toner containing portion 42, the waste toner is fed by the waste toner collection coil 43 to be collected.

The cleaning blade 41 is preferably made of a urethane rubber and is contacted with the surface of the photoreceptor 10 so as to counter the rotating photoreceptor. Thus, toner particles remaining on the surface of the photoreceptor 10 are scraped off by the edge of the cleaning blade 41. The toner particles are fed by the waste toner collection coil 43 to a waste toner tank (not shown). In this embodiment, the thus collected waste toner is not reused. It is preferable to stably contact the blade 41 with the surface of the photoreceptor 10 with high precision.

The lubricant applicator 20 is arranged between the cleaning device 40 and the charging device 30. The lubricant applicator 20 includes a solid lubricant 22, a brush roller 23 (serving as a lubricant application member) configured to apply the solid lubricant 22 on the surface of the photoreceptor 10, and a smoothing blade 21 (serving as a lubricant smoothing member) configured to smooth the coated lubricant. The lubricant is coated on the surface of the photoreceptor 10 to control the friction coefficient of the surface of the photoreceptor 10 so as to fall in a relatively low range, resulting in prevention of formation of a film (such as a toner film) on the surface of the photoreceptor 10.

The solid lubricant 22 is pressure-contacted with the brush roller 23. Therefore, the surface of the lubricant 22 is scraped by the brush roller 23, and the resultant lubricant powder is coated on the surface of the photoreceptor 10. The lubricant on the surface of the photoreceptor 10 is smoothed by the smoothing blade 21, resulting in formation of a uniform thin film of the lubricant. The smoothing blade 21 can be set on the surface of the photoreceptor 10 so as to counter or trail the photoreceptor. However, it is preferable that the smoothing blade 21 is set to trail the photoreceptor as illustrated in FIG. 2. The brush roller 23 is preferably made of a material such as insulating PET (polyethylene terephthalate) fibers, electroconductive PET fibers and acrylic fibers.

Next, the operations of the image forming apparatus 200 including the process cartridge 100 will be explained.

Referring to FIGS. 1 and 2, the photoreceptor 10 is clockwise rotated, and is charged with the charger 31 to have the target potential with the predetermined polarity. An optical writing device 70 irradiates the charged photoreceptor 10 with a laser beam L, which has been modulated with image information, to form an electrostatic latent image on the surface of the photoreceptor 10.

The developing device 50 develops the electrostatic latent image with the developer (i.e., the toner of the present invention) to visualize the latent image using the toner. Thus, different color toner images are formed on the surface of the respective photoreceptors 10. The thus formed color toner images are transferred to the intermediate transfer belt 72 one by one by primary transfer rollers 71 which are arranged so as to face the respective photoreceptors with the intermediate transfer medium 72 therebetween and to which a transfer voltage is applied. Thus, color toner images are overlaid on the surface of the intermediate transfer belt 72, resulting in formation of a multi-color image.

Toner particles remaining on the surface of the photoreceptor 10 are removed therefrom by the cleaning blade 41. The solid lubricant 22 is applied on the thus cleaned surface of the photoreceptor 10 using the brush roller 23, and the coated lubricant is smoothed by the smoothing blade 21. Thus, the friction coefficient of the surface of the photoreceptor is decreased, resulting in improvement of the cleanability of the photoreceptor 10.

The multi-color image formed on the intermediate transfer medium 72 is transferred on a receiving material. Specifically, as illustrated in FIG. 1, the receiving material containing and feeding section 230 has a paper feeding cassette configured to contain sheets of the receiving material (such as papers), which is located in the bottom of the main body of the image forming apparatus. An uppermost sheet of the receiving material in the cassette is timely fed to the transfer nip between the intermediate transfer belt 72 and the secondary transfer roller 75, to which a transfer bias is applied by a power source (not shown). Therefore, the multi-color toner image on the intermediate transfer medium is secondarily transferred onto the receiving sheet.

The receiving sheet bearing the toner image is then fed to a fixing device 90, which applies heat and pressure to the image to fix the toner image on the receiving sheet. The receiving sheet on which the multi-color image is fixed is then discharged by a pair of discharge rollers to a discharge tray located on an upper portion of the image forming apparatus 200.

The image forming method and apparatus of the present invention are not limited thereto. For example, toner images formed on one or more image bearing members can be directly transferred onto a receiving material.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of First Binder Resisn

The following components were contained in a dropping funnel.

| Vinyl monomers | |
|---|---|
| Styrene | 600 g |
| Butyl acrylate | 110 g |
| Acrylic acid | 30 g |
| Dicumylperoxide (polymerization initiator) | 30 g |

The following components were contained in a four necked 5-liter flask equipped with a thermometer, a stainless stirrer, a condenser, and a nitrogen feed pipe.

| Monomers for polyester resin | |
|---|---|
| Polyoxypropylene(2.2)-2,2-bis(4-hydroxylphenyl)propane | 1230 g |
| Polyoxyethylene(2.2)-2,2-bis(4-hydroxylphenyl)propane | 290 g |
| Isododecenyl succinic anhydride | 250 g |
| Terephthalic acid | 310 g |

-continued

| Monomers for polyester resin | |
|---|---|
| 1,2,4-benzenetricarboxylic acid anhydride | 180 g |
| Dibutyl tin oxide (esterification catalyst) | 7 g |
| Paraffin wax (melting point: 73.3° C., half width of absorption peak in DSC: 4° C., weight ratio of monomers to wax: 100:11) | 340 g |

The components in the four-necked flask were heated to 160° C. by a mantle heater under a nitrogen gas flow while agitated with the stirrer. In addition, the components in the dropping funnel was dropped in the flask over one hour. After the mixture was heated for 2 hours at 160° C. to complete an addition polymerization reaction, the reaction product was heated to 230° C. to perform a polycondensation reaction. The polymerization degree of the reaction product was occasionally checked using a constant-pressure orifice rheometer. When the reaction product had a desired softening point, the polycondensation reaction was stopped. Thus, a first resin H having a softening point of 130° C. was prepared.

Preparation of Second Binder Resin

The following components were contained in a four necked 5-liter flask equipped with a thermometer, a stainless stirrer, a condenser, and a nitrogen feed pipe.

| Monomers for polyester resin | |
|---|---|
| Polyoxypropylene(2.2)-2,2-bis(4-hydroxylphenyl)propane | 2210 g |
| Terephthalic acid | 850 g |
| 1,2,4-benzenetricarboxylic anhydride | 120 g |
| Dibutyl tin oxide (esterification catalyst) | 0.5 g |

The components in the four-necked flask were heated to 230° C. by a mantle heater under a nitrogen gas flow while agitated with the stirrer to perform a polycondensation reaction. The polymerization degree of the reaction product was occasionally checked using a constant-pressure orifice rheometer. When the reaction product had a desired softening point, the polycondensation reaction was stopped. Thus, a second binder resin L having a softening point of 115° C. was prepared.

Preparation of Toner

The following components were mixed with a HENSCHEL MIXER mixer.

| | |
|---|---|
| First binder resin | 70 parts |
| Second binder resin | 30 parts |
| C.I. Pigment Red 57-1 (which is included in a pigment master batch in a pigment/resin ratio of 0.5) | 4 parts |

The mixture was then melted and kneaded with a double-axis kneader PCM-30 from Ikegai Corp, from which a discharging portion had been removed. The kneaded mixture was then cooled by a cooling press roller so as to have a thickness of 2 mm, followed by cooling with a cooling belt. After the cooled mixture was crushed with a feather mill, the particles were pulverized with a mechanical pulverizer KTM from Kawasaki Heavy Industries, Ltd. so as to have an average particle diameter of from 10 to 12 μm, followed by pulverization with a jet pulverizer IDS from Nippon Pneumatic Mfg. Co., Ltd. while being subjected to a coarse particle classification. The pulverized mixture was then subjected to a fine particle classification using a rotor classifier TURBOPLEX 100 ATP from Hosokawa Micron Corp. Thus, a colored particulate resin T having a volume average particle diameter of 8.6 μm and a softening point of 121.8° C. was prepared.

The following components were mixed for 60 seconds using a HENSCHEL MIXER mixer, which is rotated at a peripheral speed of 45 m/s).

| | |
|---|---|
| Colored particulate resin T | 100 parts |
| Porous silica, surface of which is treated with hexamethyldisilazane (HMDS) (first external additive) (BET specific surface area of 900 $m^2/g$, average primary particle diameter of 200 nm) | 1.0 part |
| Hydrophobized silica, surface of which is treated with hexamethyldisilazane (HMDS) (second external additive) (RX200 from Nippon Aerosil Co., BET specific surface area of 200 $m^2/g$, average primary particle diameter of 12 nm) Thus, a magenta toners T1 was prepared. | 1.5 parts |

Comparative Examples 1 and 2

The procedure for preparation of the toner in Example 1 was repeated except that the porous silica serving as the first external additive was replaced with silicas which are not porous and which had been treated with HMDS) to prepare magenta toners T2 and T3.

The details of the porous silica and non-porous silicas mentioned above for use as the first external additive and hydrophobized silica mentioned above for use as the second external additive are as follows.

Porous Silica Used for Example 1

At first, a hydrophobized porous silica (SYLOPHOBIC 200 from Fuji Silysia Chemical Ltd., which has an average primary particle diameter of about 4 nm and which is subjected to a surface treatment using HMDS) was mixed with ethanol in a weight ratio of 10/90 by weight (i.e., 10% ethanol dispersion). Then the mixture was subjected to a wet pulverization treatment using a mill (STAR MILL ZRS2 from Ashizawa Finetech Ltd. and zirconia beads having a diameter of 0.2 mm. Thus, the above-mentioned porous silica having a BET specific surface area of 900 $m^2/g$, and an average primary particle diameter of 200 nm was prepared. The porous silica had been preserved as a slurry. At a time just before mixing with the colored particulate resin T, the porous silica slurry was dried and the dried powder was dissociated using a mixer, HENSCHEL MIXER 20C. The thus prepared dried porous silica was used for the toner.

Silica Serving as Second External Additive Used for Example 1 and Comparative Examples 1 and 2

A hydrophobized silica RX200 (from Nippon Aerosil Co.), which is prepared by a combustion method (i.e., a dry method), was used as the second external additive. The silica has a BET specific surface area of 200 $m^2/g$ and an average primary particle diameter of 12 nm, and the surface thereof is treated with HMDS.

Silica Serving as First External Additive an Comparative Example 1

A non-porous hydrophobized silica (TG-811F from Cabot Specialty Chemicals Inc.) having a relatively large specific surface area and prepared by a combustion method (dry method) is used. The non-porous hydrophobized silica has a BET specific surface area of 230 $m^2/g$ and an average primary particle diameter of 8 nm, and the surface thereof is treated with HMDS.

Silica Serving as First External Additive in Comparative Example 2

A non-porous hydrophobized silica (EP-BR0401 from Cabot Specialty Chemicals Inc.) having a relatively large specific surface area and prepared by a combustion method (dry method) is used. The non-porous hydrophobized silica has a BET specific surface area of 200 $m^2/g$ and an average primary particle diameter of 18 nm, and the surface thereof is treated with HMDS.

The details of the first and second external additives of the toners of Example 1 and Comparative Examples 1 and 2 are described in Table 1 below.

TABLE 1

| | First external additive | | | | Second external additive | |
|---|---|---|---|---|---|---|
| | | | Primary | | | |
| Toner | Material | Surface area ($m^2/g$) | Particle Diameter (nm) | Added Amont (parts) | Material | Added Amont (parts) |
| T1 (Ex. 1) | Porous silica treated with HMDS | 900 | 200 | 1.0 | RX200 treated with HMDS | 1.5 |
| T2 (Comp. Ex. 1) | Non-porous silica treated with HMDS | 230 | 8 | 1.0 | RX200 treated with HMDS | 1.5 |
| T3 (Comp. Ex. 2) | Non-porous silica treated with HMDS | 18 | 200 | 1.0 | RX200 treated with HMDS | 1.5 |

The evaluation methods are as follows.

(1) Particle Diameter Distribution and Average Particle Diameter

The particle diameter distribution, volume average particle diameter (Dv) and number average particle diameter (Dp) of the colored particulate resin were determined using an instrument such as COULTER COUNTER TA-II or COULTER MULTISIZER II (from Beckman Coulter Inc.).

The measurement method is as follows:

(1) 0.1 to 5 ml of a surfactant serving as a dispersant (preferably an aqueous solution of an alkylbenzenesulfonic acid salt) is added to 100 to 150 ml of an electrolyte such as 1% aqueous solution of first class NaCl or ISOTON-II manufactured by Beckman Coulter, Inc.;

(2) 2 to 20 mg of a sample (i.e., a toner) to be measured is added into the mixture;

(3) the mixture is subjected to an ultrasonic dispersion treatment for about 1 to 3 minutes; and (4) the volume average particle diameter distribution and number average particle diameter distribution of the toner are determined using the instrument mentioned above and an aperture of 100 μm.

The weight average particle diameter and number average particle diameter of the toner can be determined from the thus obtained volume and number average particle diameter distributions.

In this case, the particle diameter channels are following 13 channels (C1 to C13):

2.00 μm≦C1<2.52 μm; 2.52 μm≦C2<3.17 μm;
3.17 μm≦C3<4.00 μm; 4.00 μm≦C4<5.04 μm;
5.04 μm≦C5<6.35 μm; 6.35 μm≦C6<8.00 μm;
8.00 μm≦C7<10.08 μm; 10.08 μm≦C8<12.70 μm;
12.70 μm≦C9<16.00 μm; 16.00 μm≦C10<20.20 μm;
20.20 μm≦C11<25.40 μm; 25.40 μm≦C12<32.00 μm; and
32.00 μm≦C13<40.30 μm.

Thus, particles having a particle diameter not less than 2.00 μm and less than 40.30 μm are targeted.

(2) Softening Point

The softening point of a resin and the colored particulate resin is measured using a flow tester CFT-500 from Shimadzu Corp. The measuring conditions are as follows:

Weight of sample: 1.5 g

Die: diameter of 1 mm, and height of 1 mm

Pressure applied: $2.94\times10^6$ Pa (30 kgf/cm$^2$)

Temperature rising speed: 3° C./min

Pre-heating time: 180 seconds

Measurement temperature range: 80 to 140° C.

A sample is heated under the conditions mentioned above. The softening point of the sample is defined as the temperature [T(½)] at which the half of the sample is flown out of the die.

(3) BET Specific Surface Area of Inorganic Material

An automatic specific surface area measuring instrument (AUTOSORB 1C/VP from Yuasa Ionics Inc.) is used for determining the BET specific surface area of inorganic materials. The procedure is as follows.

1) Start-Up of Instrument

At first, the main cocks of the bottles containing a helium gas and a nitrogen gas, respectively, are opened so that the second pressures of the gasses are controlled so as to be 0.07 MP, respectively. Then the PC is turned on.

2) Pretreatment of Sample to be Measured

A pellet cell with a diameter of 9 mm is set in the instrument after the weight thereof is measured. A sample is fed into the cell such that about 80% of the cell is filled with the sample. The cell is inserted into the pocket of a mantle heater. The cell is connected with a deaerating station via an adaptor. Then liquefied nitrogen is fed into the Dewar vessel serving as a cold trap. Next, the mantle heater is turned on and the temperature thereof is controlled to be 150° C. while the cell is deaerated for 12 hours or more.

After the deaeration operation, the cell is cooled to room temperature. Then the total weight of the sample and the cell is measured to determine the weight of the sample.

3) Measurement

The cell is connected with the measurement station via the adaptor. Liquefied nitrogen is fed into the Dewar vessel. Information is input to "Analysis Menu". "Seven Point BET" is selected and an "OK" button is clicked. "Start" is clicked and an "OK" button is clicked to start measurement.

(4) Primary Particle Diameter of Inorganic Material

A sample is embedded into a resin. The resin including the sample is cut with a microtome to prepare a thin layer of the resin including the sample. The cross section of a particle of the sample is observed with a transmission electron microscope to determine the primary particle diameter of the particle of the sample.

(6) Evaluation Using Image Forming Apparatus

Each toner (i.e., developer) is set in an image forming apparatus, IPSIO CX2500 from Ricoh Co., Ltd. A running test in which 3000 copies of an A-4 size image with image area proportion of 5% are produced under an environmental condition of 23° C. and 45% RH is performed. Before and after the running test, the amount of the developer on the developing roller and the amount of the collected waste developer are checked. In addition, the image qualities of the initial image and the 3000$^{th}$ image are visually evaluated.

1) Method for Determining Amount of Developer on Developing Roller

A portion of 1 cm long and 7 cm wide of the developer layer formed on the developing roller is sucked with a suction pump to weigh the collected developer. The weight is divided by 7 (cm$^2$) to determine the weight (g/cm$^2$) of the developer layer per unit area. The weight of the developer layer on the developing roller is preferably from 3.5 to 6.5 g/cm$^2$.

2) Method for Determining Amount of Waste Developer

The weight of the waste toner box is measured before and after the running test to determine the amount of the waste developer collected in the running test. The amount of waste developer has units of g/3000 sheets.

3) Image Qualities

The initial image and the 3000$^{th}$ image are visually observed to evaluate the following image qualities.

i) Reflection density of the solid image (ID);

ii) Evenness of image density of the solid image in the feeding direction of A-4 sheet (Evenness);

iii) Streak image in the solid image (Streak); and iv) White spot image in the solid image (White spot).

These qualities are graded as follows.

○: Good (Image density is not lower than 1.40)

Δ: Usable (the phenomenon is observed but the image is still acceptable)

x: Unusable (the phenomenon is observed and the image is not acceptable)

The evaluation results are shown in Table 2.

TABLE 2

| | Image qualities after running test | | | | Amount of developer on developing roller (g/cm$^2$) | | Amount of waste developer |
|---|---|---|---|---|---|---|---|
| | ID | Evenness | Streak | White spot | Before Running test | After Running test | (g/3000 sheets) |
| Ex. 1 | ○ | ○ | ○ | ○ | 4.2 | 5.4 | 18.7 |
| Comp. Ex. 1 | Δ | X | X | ○ | 5.3 | 3.7 | 20.6 |
| Comp. Ex. 2 | ○ | ○ | X | X | 4.5 | 6.1 | 22.4 |

It is clear from Table 2 that the toner (developer) of the present invention can produce high quality images even after long repeated use.

This document claims priority and contains subject matter related to Japanese Patent Application No. 2006-251998, filed on Sep. 19, 2006, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner comprising:

toner particles comprising:

a binder resin, and a colorant; and an external additive present on a surface of the toner particles, wherein the external additive comprises a silica having an average primary particle diameter of from 100 to 500 nm and a BET specific surface area of from 800 to 1000 $m^2/g$, wherein the silica is included in the toner in an amount of from 0.1 to 1.5 parts by weight based on 100 parts by weight of the toner particles.

2. The toner according to claim 1, wherein the silica is a porous silica.

3. An image forming method comprising:

forming an electrostatic image on an image bearing member;

developing the electrostatic image with a developer including the toner according to claim 1 to form a toner image on the image bearing member; and transferring the toner image onto a receiving material optionally via an intermediate transfer medium.

4. An image forming apparatus comprising:

an image bearing member configured to bear an electrostatic image thereon;

a developing device configured to develop the electrostatic image with a developer including the toner according to claim 1 to form a toner image on the image bearing member;

a transfer device configured to transfer the toner image to a receiving material optionally via an intermediate transfer medium; and a fixing device configured to fix the toner image on the receiving material.

5. A process cartridge comprising:

an image bearing member configured to bear an electrostatic latent image thereon; and a developing device configured to develop the electrostatic latent image with a developer including the toner according to claim 1 to form a toner image on the image bearing member, wherein the image bearing member and the developing device are detachably attachable to an image forming apparatus as a unit.

6. The toner as claimed in claim 1, wherein the silica has an average primary particle diameter of from 100 to 300 nm.

7. The toner as claimed in claim 1, wherein the silica is included in the toner in an amount of from 0.5 to 1.5 parts by weight based on 100 parts by weight of the toner particles.

8. The toner as claimed in claim 1, wherein the binder resin comprises a first binder resin and a second binder resin, wherein the first binder resin and second binder resin are present in a weight ratio of from 20/80 to 45/55.

9. The toner as claimed in claim 8, wherein the first binder resin further comprises a wax.

10. The toner as claimed in claim 8, wherein the binder resin has a softening point of from 100 to 130° C.

11. The toner as claimed in claim 8, wherein the first binder resin has an acid value of from 5 to 50 mgKOH/g.

12. The toner as claimed in claim 8, wherein the second binder resin has an acid value of from 0 to 10 mgKOH/g.

13. The toner as claimed in claim 8, wherein the first binder resin comprises tetrahydrofuran-insoluble components in an amount of from 0.1 to 15% by weight.

14. The toner as claimed in claim 9, wherein the wax is a hydrocarbon wax.

* * * * *